US005845770A

United States Patent [19]

James et al.

[11] Patent Number: 5,845,770

[45] Date of Patent: Dec. 8, 1998

[54] HINGED-LID CIGARETTE PACK

[75] Inventors: Anthony G. James; Rodney G. Taylor; Colin Dennis Luton, all of Bristol, United Kingdom

[73] Assignee: Imperial Tobacco Limited, United Kingdom

[21] Appl. No.: 809,589

[22] PCT Filed: Sep. 22, 1995

[86] PCT No.: PCT/GB95/02250

§ 371 Date: May 16, 1997

§ 102(e) Date: May 16, 1997

[87] PCT Pub. No.: WO96/09230

PCT Pub. Date: Mar. 28, 1996

[30] Foreign Application Priority Data

Sep. 24, 1994 [GB] United Kingdom ..... 9419304

[51] Int. Cl.[6] ..... A24F 15/00

[52] U.S. Cl. ..... 206/268; 206/273; 229/160.1

[58] Field of Search ..... 206/268, 271, 206/273; 229/160.1

[56] References Cited

U.S. PATENT DOCUMENTS

| | | | |
|---|---|---|---|
| 5,097,948 | 3/1992 | Campbell | 206/268 |
| 5,314,062 | 5/1994 | Wu | 206/268 |
| 5,341,925 | 8/1994 | Fleenor et al. | 229/160.1 |

FOREIGN PATENT DOCUMENTS

| | | | |
|---|---|---|---|
| 723301 | 1/1932 | France | 206/268 |

*Primary Examiner*—David T. Fidel
*Attorney, Agent, or Firm*—Larson & Taylor

[57] ABSTRACT

There is provided a pack (10) for smoking articles, which pack (10) has an outer carton (15) having generally rectangular front, back, side, top and bottom panels and an inner frame (12). The outer carton (15) has an upper portion (16) and a lower portion (17) which are hingedly connected together about a hinge line which extends across the rear panel of the outer carton substantially parallel to the top and bottom edges of the rear panel. The lower edge (20) of the front panel area of the upper portion (16) has at least a portion which is not parallel to said hinge line.

9 Claims, 4 Drawing Sheets

HINGED-LID CIGARETTE PACK

BACKGROUND OF THE INVENTION

The present invention relates to packs for smoking articles.

SUMMARY OF THE INVENTION

According to the present invention there is provided a pack for smoking articles comprising an inner frame and an outer carton, the outer carton having generally rectangular front, rear, top, bottom and side panels and having upper and lower portions movable relative to each other about a hinge line extending substantially across the rear panel generally parallel with the top and bottom edges of the rear panel thereby to constitute closed and open positions, the lower edge of the front panel area of the upper portion having at least a portion which is not parallel with the hinge line.

Preferably the inner frame is retained in the lower portion of the outer hull and extends at least partially into the upper portion of the outer carton.

In one preferred arrangement said lower edge of the front panel area of the upper portion is substantially parallel with the upper edge of the front panel area of the lower portion of the outer carton. In some embodiments said lower edge abuts said upper edge.

With some arrangements said lower edge extends at an angle relative to the hinge line in a straight line across the front of the pack. In others said upper section of the lower edge extends at an angle relative to the hinge line and the lower section curves upwards therefrom towards the side edge of the front panel.

In preferred embodiments all of the lower edge of the front panel area is disposed lower than the hinge line.

Conveniently the majority of the lower edge of the front panel area comprises a folded over piece of paperboard.

Ideally the front face of the inner frame is formed with sideways projecting ears for engaging the inside of the upper portion of the outer carton thereby assisting in the retention of the pack in a closed position. Also the front face of the inner frame has a cut away portion which is positioned above the lower portion of the outer carton, the cut away portion having an edge portion which is generally parallel to the upper edge of the front area of the lower portion of the outer carton.

BRIEF DESCRIPTION OF THE DRAWINGS

Embodiments of the present invention will now be described in more detail. The description makes reference to the accompanying drawings in which.

DESCRIPTION OF THE PREFERRED EMBODIMENTS

Figure 2:
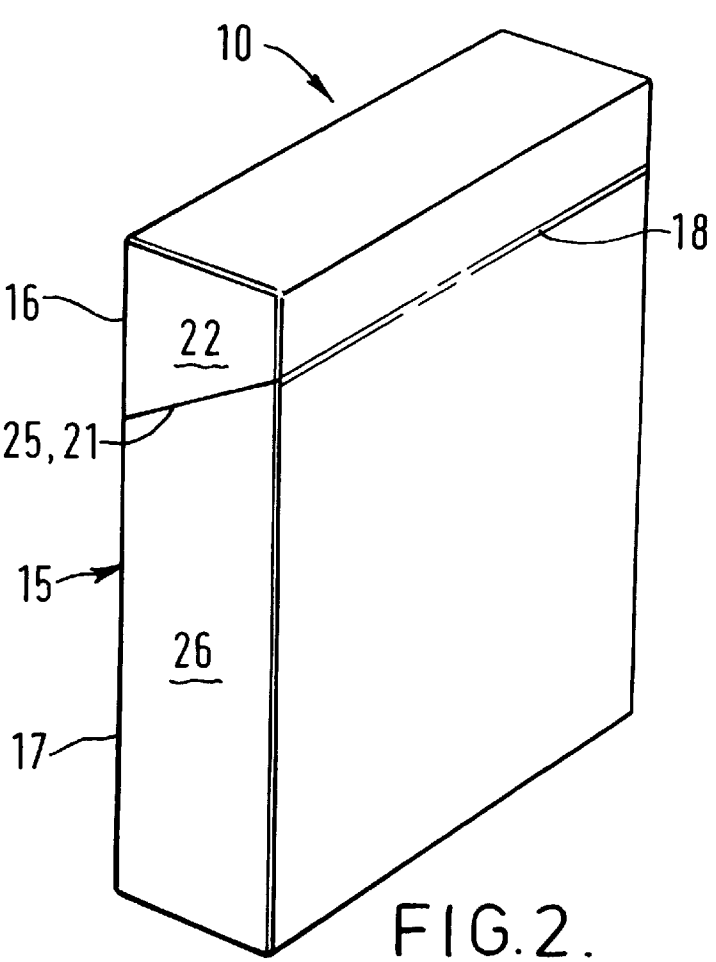
FIG. 2 is a rear perspective view from the other side of the FIG. 1 pack.
Figure 1:
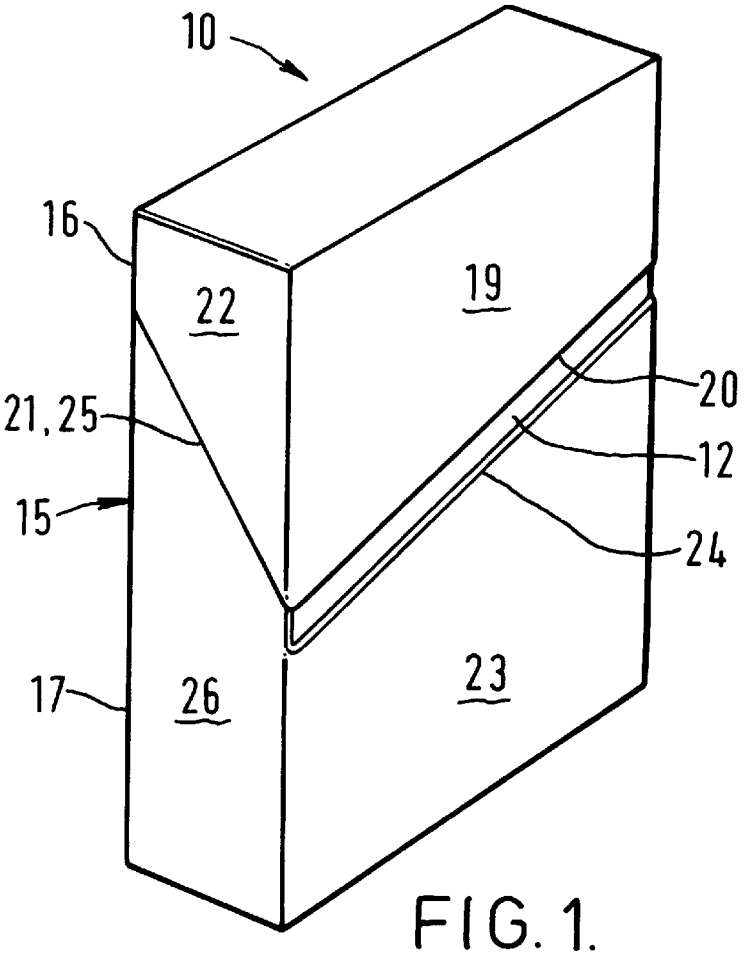
FIG. 1 is a front perspective view from one side of a pack according to the present invention.
Figure 4:
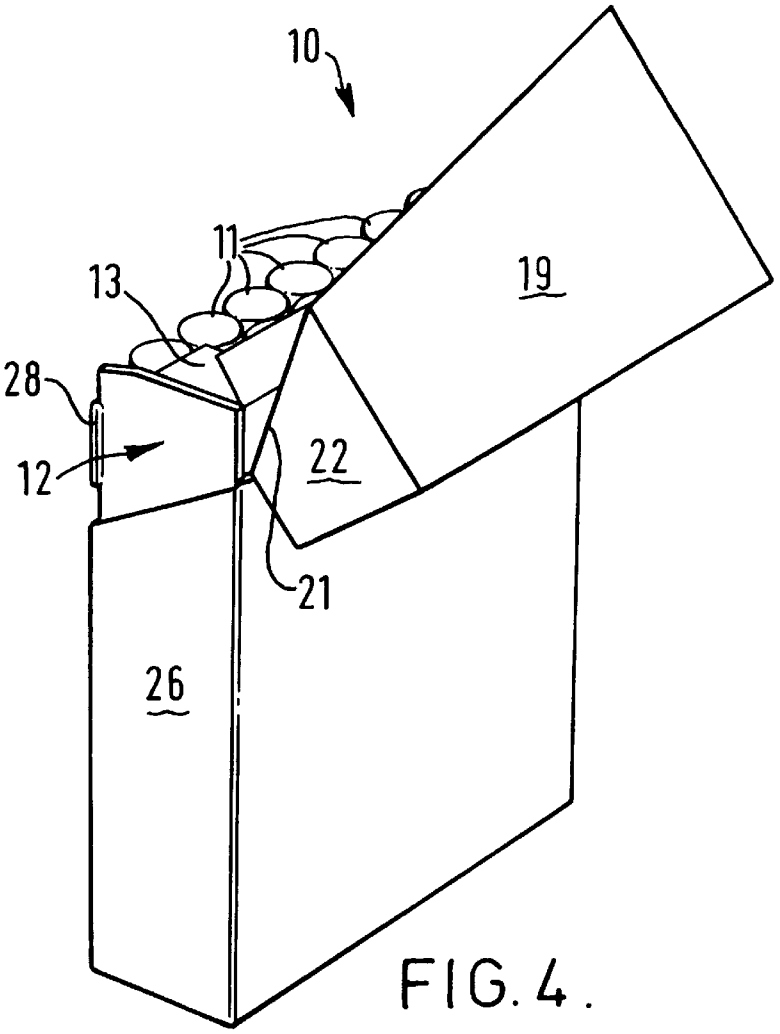
FIG. 4 is a rear perspective view from said other side of the FIG. 1 pack in an open position.
Figure 3:
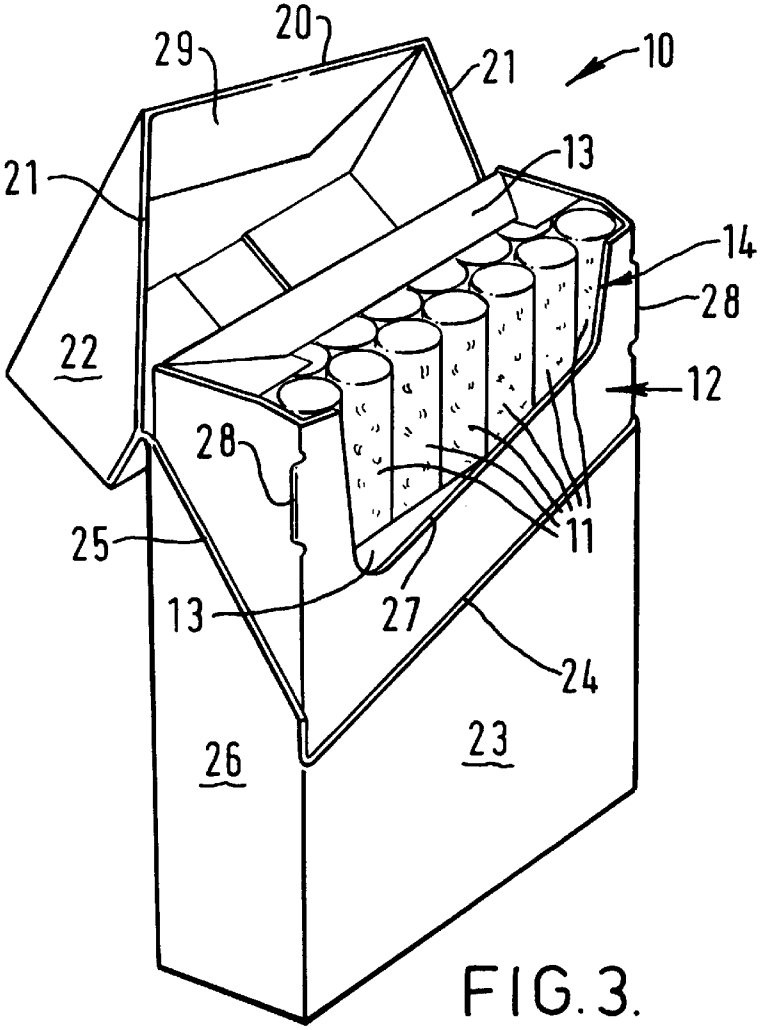
FIG. 3 is a front perspective view from said one side of the FIG. 1 pack in an open position.

FIGS. 1 to 4 show a pack 10 for cigarettes 11. The pack has an inner frame 12 in which is received a foil-wrapped bundle of the cigarettes 11. The foil 13 is shown partially removed in FIGS. 3 and 4 to expose the cigarettes 11. The inner frame 12 has a cut away portion 14 to facilitate access to the cigarettes 11.

The pack also has an outer carton 15 comprising an upper portion 16 and a lower portion 17 which are connected together along a hinge line 18 constituted by a fold in the rear panel of the pack. All of the panels of the pack are generally rectangular.

The upper portion 16 has a front panel 19 which has a lower edge 20 which is not parallel to the hinge 18. Instead the lower edge 20 comprises a straight angled line extending across the full width of the pack 10. The lower edges 21 of the side panels 22 of the upper portion 16 also extend in straight lines between the ends of the edge 20 and the hinge line 18.

The lower portion 17 has a front panel 23 which has an upper edge 24 which, in the closed condition of the pack, is parallel and spaced from the lower edge 20 of the upper portion. This exposes the portion of the inner frame 12, which portion could be of a contrasting colour for example compared to other portions of the pack. The upper edges 25 of the side panels 26 of the lower portion 17, however, abut the edges 21 of the upper portion 16.

In this embodiment, the cut away portion 14 of the inner frame 12 has a main edge 27 which is generally parallel to the upper edge 24 of the lower portion 17. This feature gives a pleasing continuity of theme in the pack design, but other variations are possible. Also the inner frame 12 is formed with sideways projecting ears 28 which engage the inside of the upper portion 16 of the outer carton 15 during closing of the pack and aids retention of the pack in its closed condition.

It can also be seen that the lower edge 20 of the upper portion is constituted by a folded under portion 29. This gives the edge 20 a smoother, stronger finish which is less susceptible to damage and wear.

If desired a simple modification to this pack would be for the upper edge 24 of the lower portion 17 to be raised so that, in the closed condition of the pack, it abuts the lower edge of the upper portion 16.

Figure 9:
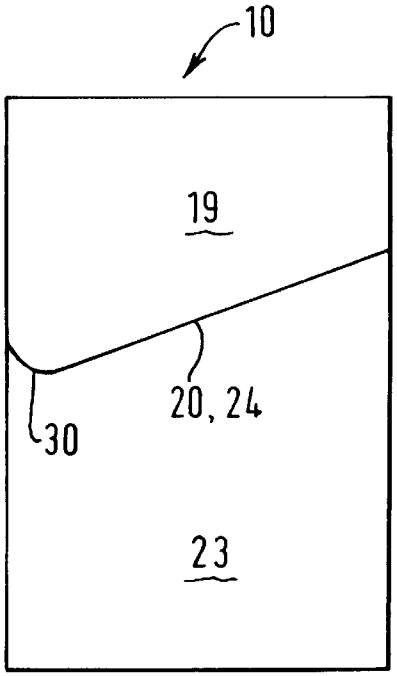
FIG. 9 is a front view of the FIG. 5 pack.
Figure 6:
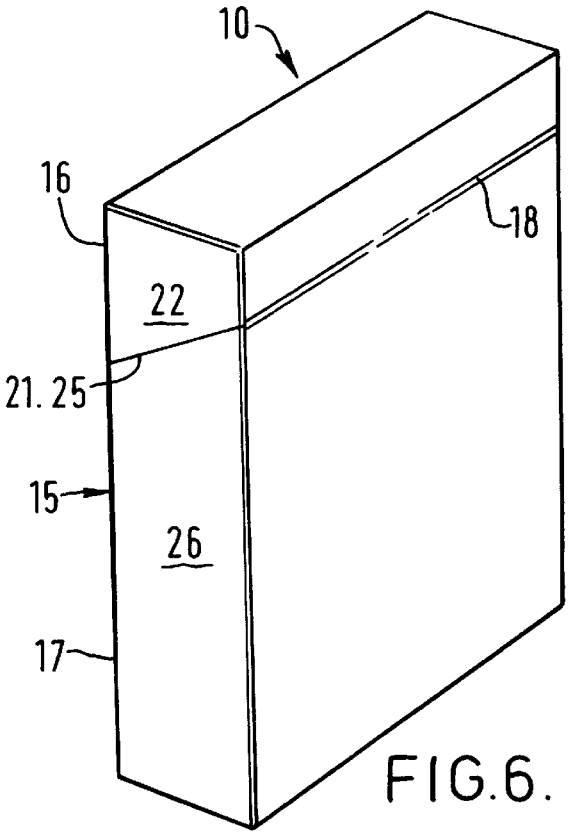
FIG. 6 is a rear perspective view from the other side of the FIG. 5 pack.
Figure 5:
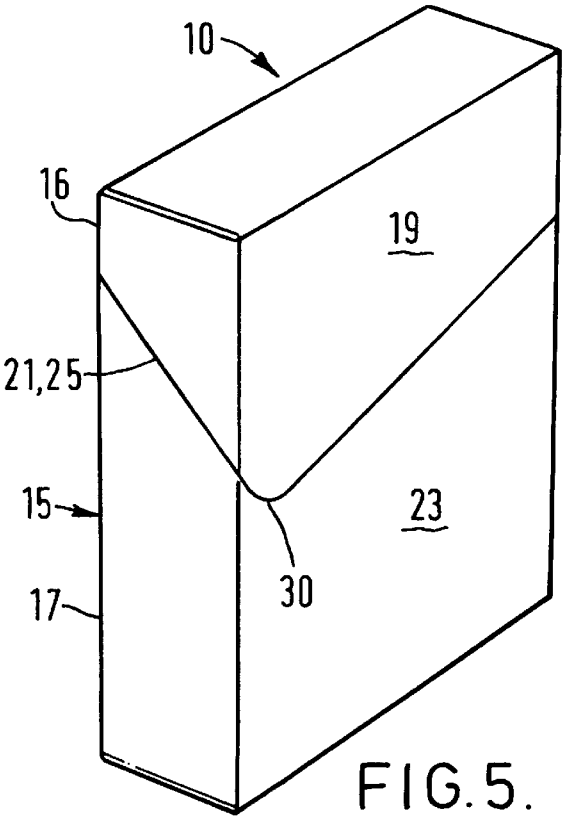
FIG. 5 is a front perspective view from one side of another pack according to the present invention.
Figure 8:
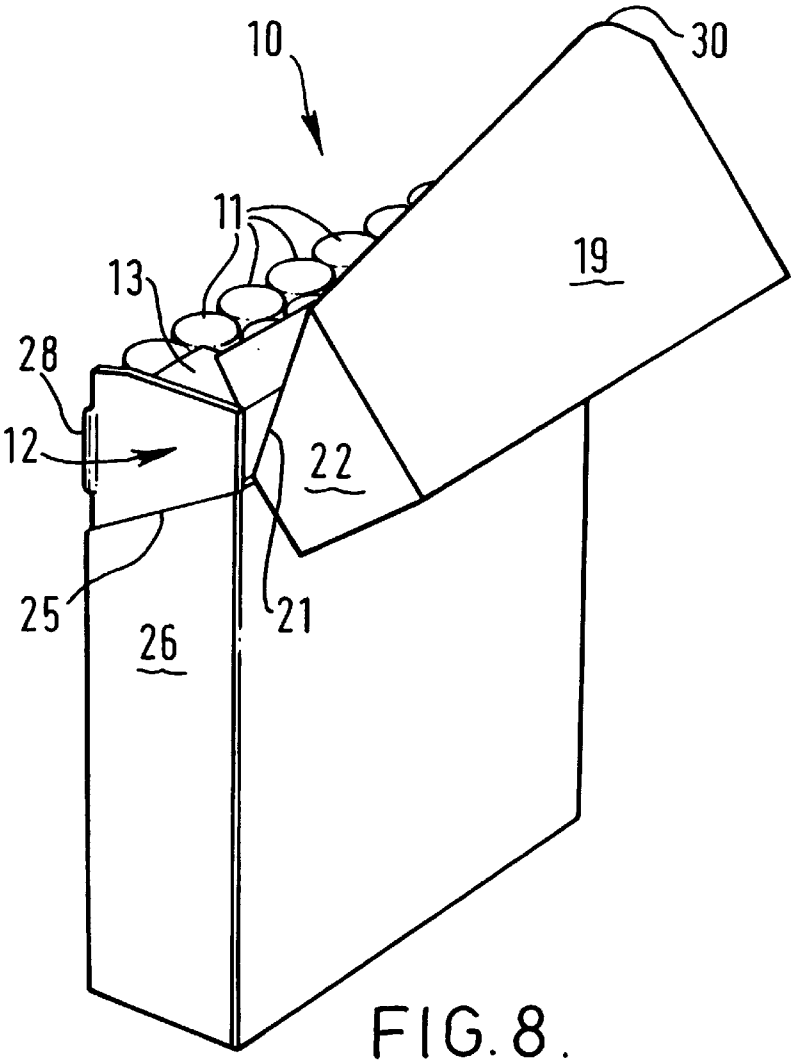
FIG. 8 is a rear perspective view from said other side of the FIG. 5 pack in an open position.
Figure 7:
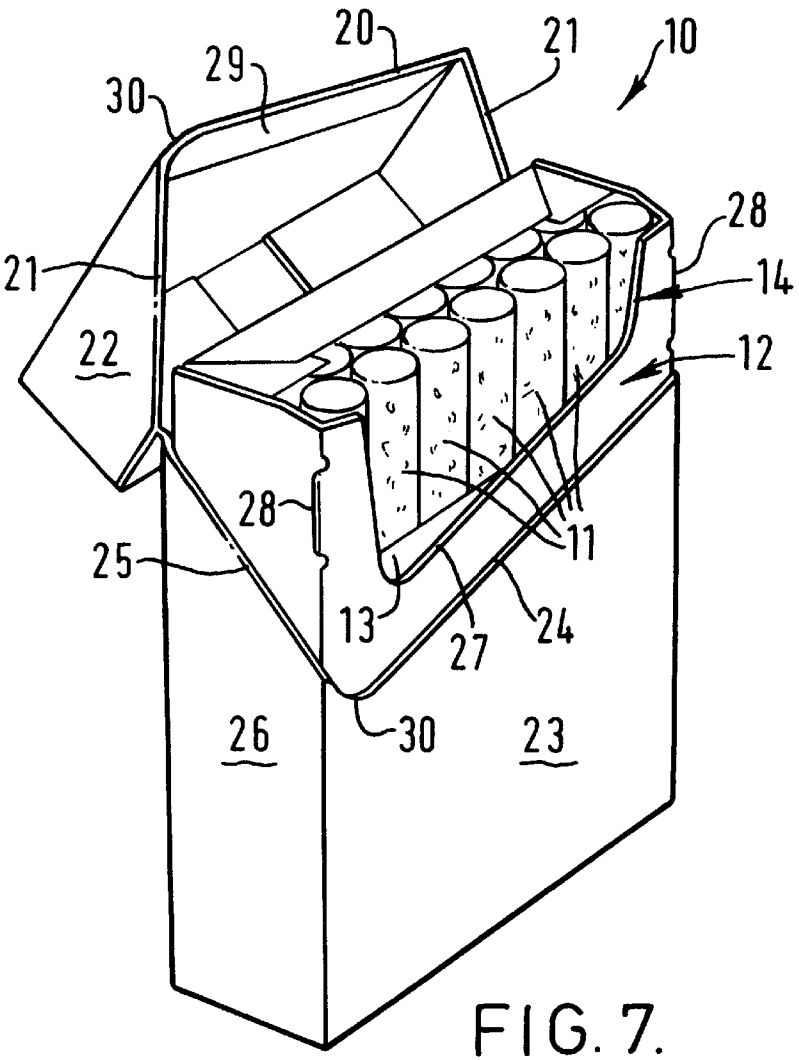
FIG. 7 is a front perspective view from said one side of the FIG. 5 pack in an open position.

In the arrangement shown in FIGS. 5 to 9 many of the features correspond to those in FIGS. 1 to 4 and so have been given identical reference numerals. The principal differences are that the lower edge 20 of the upper portion 16 and the upper edge 24 of the lower portion 17 abut and that at one side the edges 20, 24 are curved upwards at 30. The curves 30 lead smoothly into the respective edges of the side panels and tend to soften the appearance of the pack.

It will be appreciated that the actual shapes of the edges 20, 24 and also 21, 25 and indeed edge 27 are a matter of design choice, the only requirement being that the pack opens and closes. The edges need not be generally straight as shown in the above embodiments and need not abut.

It is claimed:

1. A pack for smoking articles comprising an inner frame and an outer carton, the outer carton having generally rectangular front, rear, top, bottom and side panels and having upper and lower portions movable relative to each other about a hinge line extending substantially across the rear panel generally parallel with the top and bottom edges of the rear panel thereby to constitute closed and open positions, a lower edge of the front panel of the upper portion extending at an angle relative to the hinge line in a single straight line substantially from one side panel to the opposite side panel across the front of the pack.

2. A pack as claimed in claim 1 wherein the inner frame is retained in the lower portion of the outer carton and extends at least partially into the upper portion of the outer carton.

3. A pack as claimed in claim 1 wherein said lower edge of the front panel of the upper portion is substantially parallel with an upper edge of the front panel of the lower portion of the outer carton.

4. A pack as claimed in claim 3 wherein said lower edge abuts said upper edge.

5. A pack as claimed in claim 1 wherein a lower end section of the lower edge of the front panel of the upper portion curves upwards therefrom towards the side edge of the front panel.

6. A pack as claimed in claim 1 wherein all of the lower edges of the front panel are disposed below the hinge line.

7. A pack as claimed in claim 1 wherein a majority of the lower edge of the front panel comprises a folded over piece of paperboard.

8. A pack as claimed in claim 1 wherein a front face of the inner frame is formed with sideways projecting ears for engaging an inside of the upper portion of the outer carton thereby assisting in the retention of the pack in a closed position.

9. A pack as claimed in claim 1 wherein a front face of the inner frame has a cut away portion which is positioned above the lower portion of the outer carton, the cut away portion having an edge portion which is generally parallel to an upper edge of the front of the lower portion of the outer carton.

* * * * *